US012134025B2

(12) United States Patent
Huang

(10) Patent No.: US 12,134,025 B2
(45) Date of Patent: Nov. 5, 2024

(54) POWERED WHEELED BOARD

(71) Applicant: RAZOR USA LLC, Cerritos, CA (US)

(72) Inventor: Joey Chih-Wei Huang, Temple City, CA (US)

(73) Assignee: Razor USA LLC, Cerritos, CA (US)

( * ) Notice: Subject to any disclaimer, the term of this patent is extended or adjusted under 35 U.S.C. 154(b) by 0 days.

(21) Appl. No.: 18/048,764

(22) Filed: Oct. 21, 2022

(65) Prior Publication Data

US 2023/0130257 A1 Apr. 27, 2023

Related U.S. Application Data

(63) Continuation of application No. 16/914,828, filed on Jun. 29, 2020, now Pat. No. 11,478,693, which is a continuation of application No. 16/032,347, filed on Jul. 11, 2018, now Pat. No. 10,709,960, which is a continuation of application No. 15/623,087, filed on Jun. 14, 2017, now Pat. No. 10,022,615, which is a (Continued)

(51) Int. Cl.

| | |
|---|---|
| ***A63C 17/12*** | (2006.01) |
| ***A63C 17/00*** | (2006.01) |
| ***A63C 17/01*** | (2006.01) |
| ***A63C 17/04*** | (2006.01) |

(52) U.S. Cl.

CPC ..... *A63C 17/12* (2013.01); *A63C 17/0033* (2013.01); *A63C 17/016* (2013.01); *A63C 17/04* (2013.01); *A63C 17/014* (2013.01); *A63C 2203/22* (2013.01); *A63C 2203/40* (2013.01)

(58) Field of Classification Search

CPC ..... A63C 17/12; A63C 17/0033; A63C 17/016; A63C 17/04; A63C 17/014; A63C 2203/22; A63C 2203/40

See application file for complete search history.

(56) References Cited

U.S. PATENT DOCUMENTS

| | | | |
|---|---|---|---|
| 2,051,762 | A | 8/1936 | Vincent |
| 3,288,251 | A | 11/1966 | Paul |

(Continued)

FOREIGN PATENT DOCUMENTS

| | | |
|---|---|---|
| AU | 2007214338 | 3/2007 |
| CA | 2596570 | 10/2007 |

(Continued)

OTHER PUBLICATIONS

"About: Skateboarding; Other Boardsports", http://skateboard.about.com/cs/fringeboarding/gr/?once-true&; Mar. 2007, in 2 pages.

(Continued)

*Primary Examiner* — John D Walters

(74) *Attorney, Agent, or Firm* — Knobbe, Martens, Olson & Bear, LLP

(57) ABSTRACT

Various powered wheeled board vehicles are disclosed. In some embodiments, the vehicle includes a deck having a forward portion and a rearward portion. At least one front wheel can be connected with the deck under the forward portion. The front wheel can be configured to swivel about a first axis and rotate about a second axis. A powered wheel can be connected with the rearward portion. In some configurations, the rear wheel comprises a hub motor.

12 Claims, 11 Drawing Sheets

Related U.S. Application Data continuation of application No. 14/951,371, filed on Nov. 24, 2015, now Pat. No. 9,682,309.

(60) Provisional application No. 62/085,163, filed on Nov. 26, 2014, provisional application No. 62/137,449, filed on Mar. 24, 2015.

(56) References Cited

U.S. PATENT DOCUMENTS 3,399,904 A 9/1968 Schinke
3,399,906 A 9/1968 Portnoff
3,771,811 A 11/1973 Bueno
3,982,766 A 9/1976 Budge
D243,206 S 1/1977 Sherwood
4,037,852 A 7/1977 Bayer et al.
D246,065 S 10/1977 Saul
4,060,253 A 11/1977 Oldendorf
4,076,265 A 2/1978 Eash, II
4,076,267 A 2/1978 Lipscomb
4,082,306 A 4/1978 Sheldon
4,092,033 A 5/1978 Swain
4,093,252 A 6/1978 Rue
D250,492 S 12/1978 Kish
4,140,326 A 2/1979 Huber
4,245,848 A 1/1981 Dudouyt
4,295,656 A 10/1981 Moore
4,359,231 A 11/1982 Mulcahy
4,411,442 A 10/1983 Rills
4,451,055 A 5/1984 Lee
4,902,256 A 2/1990 Berglund
4,915,403 A 4/1990 Wild
4,921,513 A 5/1990 Parten
4,930,794 A 6/1990 Chan
4,930,924 A 6/1990 Hunt
4,955,626 A 9/1990 Smith
5,029,702 A 7/1991 Tong
5,067,058 A 11/1991 Standley
5,098,087 A 3/1992 Matile
5,160,155 A 11/1992 Barachet
5,221,111 A * 6/1993 Younger ..... A63C 17/265 24/607
5,267,743 A 12/1993 Smisek
D345,406 S 3/1994 Shankland
D346,418 S 4/1994 Fischbach
5,330,026 A * 7/1994 Hsu ..... A63C 17/12 180/181
5,347,681 A 9/1994 Wattron et al.
5,419,570 A 5/1995 Bollotte
5,458,351 A 10/1995 Yu
5,460,558 A 10/1995 Woodstock
5,492,345 A 2/1996 Kruczek
5,505,474 A 4/1996 Yeh
5,529,523 A 6/1996 Wilhelmi
5,540,455 A 7/1996 Chambers
5,549,331 A 8/1996 Yun
5,566,956 A 10/1996 Wang
5,601,299 A 2/1997 Yun
5,622,759 A 4/1997 Fuster
5,707,068 A 1/1998 Bradfield
5,766,051 A 6/1998 Messer
5,826,895 A 10/1998 Bradfield
5,853,182 A 12/1998 Finkle
5,855,385 A 1/1999 Hambsch
5,884,983 A 3/1999 Wu
5,893,425 A * 4/1999 Finkle ..... A63C 17/015 180/181
D410,515 S 6/1999 Alexander
5,910,035 A 6/1999 Rebotier et al.
D413,954 S 9/1999 Gerlach
5,947,495 A 9/1999 Null et al.
5,984,328 A 11/1999 Tipton
D422,661 S 4/2000 Edwards et al.
D422,662 S 4/2000 Edwards et al.
6,050,357 A 4/2000 Staelin
6,056,302 A 5/2000 Smith
6,059,303 A 5/2000 Bradfield
6,102,415 A 8/2000 Stewardson
6,106,347 A 8/2000 Harness
6,193,249 B1 2/2001 Buscaglia
6,206,389 B1 3/2001 Yagi
6,254,113 B1 7/2001 Dornan
6,293,565 B1 9/2001 Bouchard et al.
6,315,304 B1 11/2001 Kirkland et al.
6,328,328 B1 12/2001 Finiel
6,338,494 B1 1/2002 Killian
D455,186 S 4/2002 Koester
D456,047 S 4/2002 Mandic
6,398,237 B1 6/2002 Attey
6,419,248 B1 7/2002 Kay
6,419,249 B1 7/2002 Chen
6,428,022 B1 8/2002 Namiki
6,440,526 B1 8/2002 Gamble et al.
6,481,724 B1 11/2002 Whipp
6,485,044 B1 11/2002 Blake
6,494,467 B1 12/2002 Menges
6,502,850 B1 1/2003 Schaller et al.
6,572,130 B2 6/2003 Greene et al.
6,669,215 B2 12/2003 Laporte
6,698,776 B2 3/2004 Todd
6,808,196 B2 10/2004 Des Ouches
6,863,292 B1 3/2005 Paasch et al.
D503,763 S 4/2005 Morgan
D506,427 S 6/2005 Weber
6,910,698 B2 6/2005 Turner et al.
D510,046 S 9/2005 Li
6,976,687 B2 12/2005 Beleki, Jr.
6,979,006 B2 12/2005 Pierron
7,044,486 B2 5/2006 Wright
7,053,289 B2 5/2006 Iwai et al.
7,070,193 B2 7/2006 Yamaguchi
7,083,178 B2 8/2006 Potter
7,093,842 B2 8/2006 Potter
7,182,360 B2 2/2007 Paasch et al.
7,195,259 B2 3/2007 Gang
7,198,280 B2 * 4/2007 Hara ..... A63C 17/0033 280/87.01
7,213,823 B1 5/2007 Vujtech
7,252,625 B1 8/2007 Perka
D552,201 S 10/2007 Kwak
D556,283 S 11/2007 Hamborg et al.
7,316,597 B2 1/2008 Skedeleski
D561,289 S 2/2008 Stanisewski
7,325,819 B2 2/2008 Kwak
D564,613 S 3/2008 Hamborg
7,338,056 B2 3/2008 Chen et al.
7,367,572 B2 5/2008 Jiang
D572,332 S 7/2008 Sramek et al.
D577,789 S 9/2008 Mazur
7,441,787 B1 10/2008 Jordan
7,600,768 B2 10/2009 Chen
D607,521 S 1/2010 Chables et al.
D607,524 S 1/2010 Marciano
D608,851 S 1/2010 Hillman
D614,714 S 4/2010 Walworth
7,766,351 B2 8/2010 Chen et al.
7,775,534 B2 8/2010 Chen et al.
D623,701 S 9/2010 Dalgaard et al.
D623,702 S 9/2010 Dalgaard et al.
7,867,050 B2 1/2011 Crispin
7,891,680 B2 2/2011 Chen et al.
D638,494 S 5/2011 Scolari et al.
8,047,556 B2 11/2011 Jang et al.
8,061,725 B1 11/2011 Hawkins
8,118,319 B2 2/2012 Hsieh
D655,772 S 3/2012 Bin
8,157,274 B2 4/2012 Chen
D667,382 S 9/2012 Cosentino
D673,233 S 12/2012 Baggett
8,360,475 B2 1/2013 Cristiano
8,408,565 B2 4/2013 An
8,414,000 B2 * 4/2013 Chen ..... A63C 17/016 280/87.021
8,469,376 B2 6/2013 Kristiansen

(56) References Cited

U.S. PATENT DOCUMENTS

| | | | | |
|---|---|---|---|---|
| D692,079 | S | 10/2013 | Mackay | |
| D692,080 | S | 10/2013 | Hamborg et al. | |
| 8,632,084 | B2 | 1/2014 | Lovley, II et al. | |
| D698,881 | S | 2/2014 | Hamborg | |
| D699,803 | S | 2/2014 | Yamabe | |
| D705,372 | S | 5/2014 | Harris | |
| 8,720,916 | B2 | 5/2014 | Bermal | |
| 8,857,831 | B1 | 10/2014 | Rotondo | |
| 8,864,152 | B1 | 10/2014 | Danze | |
| 8,915,506 | B2 | 12/2014 | Piaceski et al. | |
| 8,936,263 | B2 | 1/2015 | Rawlins | |
| D724,166 | S | 3/2015 | Hamborg et al. | |
| D728,048 | S | 4/2015 | Stover | |
| 9,010,778 | B1 | 4/2015 | Burns | |
| D739,906 | S | 9/2015 | Chen | |
| D743,381 | S | 11/2015 | Pi et al. | |
| 9,186,570 | B1 | 11/2015 | Wells | |
| 9,302,173 | B2 | 4/2016 | DiCarlo | |
| 9,393,481 | B2 | 7/2016 | Fournier | |
| D770,585 | S | 11/2016 | Desberg | |
| 9,492,731 | B2 | 11/2016 | Marusiak et al. | |
| D785,115 | S | 4/2017 | Ying | |
| D789,366 | S | 6/2017 | Jentz et al. | |
| D790,015 | S | 6/2017 | Tan | |
| 9,682,309 | B2 | 6/2017 | Huang | |
| D792,931 | S | 7/2017 | Desberg | |
| D799,450 | S | 10/2017 | Lee et al. | |
| 9,795,864 | B1 | 10/2017 | Bao | |
| 9,975,035 | B1 | 5/2018 | Wang | |
| 10,022,615 | B2 | 7/2018 | Huang | |
| 10,022,616 | B1 | 7/2018 | Consol | |
| D827,748 | S | 9/2018 | Desberg | |
| D829,838 | S | 10/2018 | Huang | |
| D865,096 | S | 10/2019 | Desberg | |
| 10,486,052 | B2 | 11/2019 | Choi | |
| D871,532 | S | 12/2019 | Huang | |
| 10,625,830 | B2 | 4/2020 | Lenchner et al. | |
| 10,709,960 | B2 | 7/2020 | Huang | |
| 10,787,218 | B2 | 9/2020 | Wen | |
| D899,543 | S | 10/2020 | Desberg | |
| D911,476 | S | 2/2021 | Huang | |
| D920,197 | S | 5/2021 | Wan | |
| D940,805 | S | 1/2022 | Desberg | |
| D942,572 | S | 2/2022 | Huang | |
| 11,273,363 | B1 | 3/2022 | Degraff | |
| 11,446,562 | B2 | 9/2022 | Desberg | |
| 11,478,693 | B2 | 10/2022 | Huang | |
| 11,844,998 | B2 | 12/2023 | Desberg | |
| D1,012,217 | S | 1/2024 | Huang | |
| 2002/0043774 | A1 | 4/2002 | Chou | |
| 2002/0067015 | A1 | 6/2002 | Tierney et al. | |
| 2002/0149166 | A1 | 10/2002 | Potter | |
| 2002/0195788 | A1 | 12/2002 | Tierney et al. | |
| 2003/0124923 | A1 | 7/2003 | Mercer | |
| 2003/0141688 | A1 | 7/2003 | Lynn | |
| 2003/0155725 | A1 | 8/2003 | Roderick | |
| 2003/0155733 | A1 | 8/2003 | Tan et al. | |
| 2004/0021281 | A1 | 2/2004 | Stephens | |
| 2004/0144582 | A1 | 7/2004 | Baker et al. | |
| 2004/0163867 | A1 | 8/2004 | Hillman | |
| 2004/0212160 | A1 | 10/2004 | Roderick | |
| 2004/0262872 | A1 | 12/2004 | Kang | |
| 2005/0160902 | A1 | 7/2005 | Iwai et al. | |
| 2006/0032682 | A1 | 2/2006 | Hillman | |
| 2006/0032685 | A1 | 2/2006 | Koide | |
| 2006/0038361 | A1 | 2/2006 | Sano | |
| 2006/0049595 | A1* | 3/2006 | Crigler | A63C 17/12 280/87.042 |
| 2006/0055135 | A1 | 3/2006 | Tracewell et al. | |
| 2006/0055137 | A1 | 3/2006 | Jiang | |
| 2006/0163830 | A1 | 7/2006 | Kwak | |
| 2007/0001414 | A1 | 1/2007 | Kang | |
| 2007/0035102 | A1 | 2/2007 | McClain | |
| 2007/0132199 | A1 | 6/2007 | Smith | |
| 2007/0252355 | A1 | 11/2007 | Chen et al. | |
| 2007/0257459 | A1 | 11/2007 | Gang | |
| 2007/0272465 | A1* | 11/2007 | Su | A63C 17/014 180/181 |
| 2007/0273118 | A1* | 11/2007 | Conrad | A63C 17/016 280/87.042 |
| 2007/0296164 | A1 | 12/2007 | Roderick | |
| 2009/0045598 | A1 | 2/2009 | Lee | |
| 2009/0058028 | A1 | 3/2009 | Chen | |
| 2009/0134591 | A1 | 5/2009 | Chen et al. | |
| 2009/0200764 | A1* | 8/2009 | Jang | A63C 17/015 280/87.042 |
| 2009/0206571 | A1 | 8/2009 | Francom et al. | |
| 2009/0270002 | A1 | 10/2009 | Crispin | |
| 2009/0295111 | A1 | 12/2009 | O'Rourke | |
| 2010/0222941 | A1 | 9/2010 | Chang | |
| 2010/0225080 | A1 | 9/2010 | Smith | |
| 2010/0253027 | A1 | 10/2010 | Chen et al. | |
| 2011/0006497 | A1 | 1/2011 | Chen et al. | |
| 2011/0037238 | A1 | 2/2011 | Devine | |
| 2011/0127740 | A1 | 6/2011 | Yamabe | |
| 2011/0133420 | A1 | 6/2011 | Smith | |
| 2011/0187069 | A1 | 8/2011 | Marcel | |
| 2012/0091677 | A1 | 4/2012 | Wu | |
| 2012/0125807 | A1 | 5/2012 | Jones et al. | |
| 2012/0187648 | A1 | 7/2012 | Chen | |
| 2013/0001910 | A1 | 1/2013 | Hsu | |
| 2013/0168936 | A1 | 7/2013 | Morita | |
| 2013/0277939 | A1 | 10/2013 | Yamabe | |
| 2014/0210175 | A1 | 7/2014 | Hsu | |
| 2015/0160902 | A1 | 6/2015 | Tsujita | |
| 2015/0202526 | A1 | 7/2015 | Rawlins | |
| 2016/0332062 | A1 | 11/2016 | Wu et al. | |
| 2017/0056756 | A1 | 3/2017 | Pikulski | |
| 2017/0151489 | A1 | 6/2017 | Kim | |
| 2018/0273129 | A1 | 9/2018 | Baron | |
| 2018/0296907 | A1 | 10/2018 | Huang | |
| 2018/0318698 | A1 | 11/2018 | Ji | |
| 2018/0361226 | A1 | 12/2018 | Cho | |
| 2019/0070486 | A1 | 3/2019 | Shi | |
| 2020/0282296 | A1 | 9/2020 | Chen et al. | |
| 2020/0346099 | A1 | 11/2020 | Li | |
| 2022/0096913 | A1 | 3/2022 | Chen et al. | |
| 2023/0102779 | A1 | 3/2023 | Kermani et al. | |
| 2023/0134906 | A1 | 5/2023 | Desberg | |

FOREIGN PATENT DOCUMENTS

| | | | |
|---|---|---|---|
| CN | 101309730 | | 11/2008 |
| CN | 201205442 | | 3/2009 |
| CN | 201482126 | U | 5/2010 |
| CN | 201505425 | U | 6/2010 |
| CN | 202070117 | U | 12/2011 |
| CN | 206183946 | | 5/2017 |
| CN | 207157383 | U | 3/2018 |
| CN | 304695609 | S | 6/2018 |
| CN | 207667107 | U | 7/2018 |
| CN | 214209406 | U | 9/2021 |
| DE | 202008012754 | | 1/2009 |
| DK | 176806 | | 10/2009 |
| EP | 1511541 | | 3/2005 |
| EP | 1679101 | | 7/2006 |
| GB | 2318519 | | 4/1998 |
| GB | 2464676 | | 4/2010 |
| JP | H01-117385 | U | 8/1989 |
| JP | H10-211313 | | 8/1998 |
| JP | 2000-500369 | | 1/2000 |
| JP | 2001-029663 | | 2/2001 |
| JP | 2005-537820 | | 12/2005 |
| JP | A 2015-527908 | | 9/2015 |
| KR | 10 20050060368 | | 6/2005 |
| KR | 200 400 315 | Y1 | 11/2005 |
| KR | 200 410 530 | Y1 | 3/2006 |
| KR | 10-2007-0047491 | | 5/2007 |
| KR | 10-2007-0098467 | | 10/2007 |
| KR | 20090003996 | U | 4/2009 |
| KR | 10-0921839 | | 10/2009 |
| KR | 10-20010110239 | | 12/2011 |
| KR | 20120000804 | U | 2/2012 |
| KR | 200462622 | Y1 | 9/2012 |

(56) References Cited

FOREIGN PATENT DOCUMENTS

| | | | |
|---|---|---|---|
| KR | 200465548 | Y1 | 2/2013 |
| KR | 20160002496 | A | 1/2016 |
| SU | 1405865 | | 4/1986 |
| TW | 247446 | | 5/1995 |
| TW | 266104 | | 12/1995 |
| TW | M427179 | U | 4/2012 |
| WO | WO 1993/01870 | | 2/1993 |
| WO | WO 1997/018865 | | 5/1997 |
| WO | WO 1999/39787 | | 8/1999 |
| WO | WO 2002/040116 | | 5/2002 |
| WO | WO 2003/092831 | | 11/2003 |
| WO | WO 2004/105901 | | 12/2004 |
| WO | WO 2006/022472 | | 3/2006 |
| WO | WO 2007/102645 | | 9/2007 |
| WO | WO 2007/111466 | | 10/2007 |
| WO | WO 2007/117092 | | 10/2007 |
| WO | WO 2007/127554 | | 11/2007 |
| WO | WO 2007/139356 | | 12/2007 |
| WO | WO 2009/036074 | | 3/2009 |
| WO | WO 2009/100722 | | 8/2009 |
| WO | WO 2009/128586 | | 10/2009 |
| WO | WO 2010/019627 | | 2/2010 |
| WO | WO 2012/083950 | | 6/2012 |
| WO | WO 2013/012129 | A1 | 1/2013 |
| WO | WO 2014/009760 | | 1/2014 |
| WO | WO 2016/086066 | A1 | 6/2016 |
| WO | WO 2016/094806 | A1 | 6/2016 |
| WO | WO 2018/195103 | | 10/2018 |
| WO | WO 2020/181093 | | 9/2020 |
| WO | WO 2021/055852 | | 3/2021 |
| WO | WO 2022/072367 | A1 | 4/2022 |
| WO | WO 2023/056340 | A1 | 4/2023 |

OTHER PUBLICATIONS

"About: Skateboarding; The Wave" http://skateboard.about.com/cs/fringeboarding/gr/XBoard.html; Jan. 2007, in 2 pages.

Micelle' Electric Wave Board [XinCheJian], URL—http://xinchejian.com/2011/05/07/miclles-electric-wave-board/; May 2011, in 6 pages.

The Wave, Streetsurfing, http://www.streetsurfing.com/wave/skating.html; Mar. 2007, in 2 pages.

International Search Report and Written Opinion for International Application No. PCT/US2015/062534, Feb. 15, 2016.

International Preliminary Report on Patentability for International Application No. PCT/US2015/062534, Jun. 8, 2017, in 8 pages.

Pre-Appeal Examination Report in corresponding Japanese Patent Application No. 2021-003397, Feb. 1, 2023, in 10 pages.

* cited by examiner

POWERED WHEELED BOARD

CROSS REFERENCE

This application is a continuation of U.S. patent application Ser. No. 16/914,828, filed Jun. 29, 2020, which is a continuation of U.S. patent application Ser. No. 16/032,347, filed Jul. 11, 2018, which is a continuation of U.S. patent application Ser. No. 15/623,087, filed Jun. 14, 2017, which is a continuation of U.S. patent application Ser. No. 14/951,371, filed Nov. 24, 2015, which claims the priority benefit under 35 U.S.C. § 119 of U.S. Patent Application No. 62/085,163, filed Nov. 26, 2014, and U.S. Patent Application No. 62/137,449, filed Mar. 24, 2015, the entirety of each of the above-mentioned applications are hereby incorporated by reference. Additionally, any applications for which a foreign or domestic priority claim is identified in the Application Data Sheet as filed with the present application are hereby incorporated by reference in their entirety.

BACKGROUND

Field

The present disclosure relates to personal mobility vehicles, such as skateboards. In particular, the present disclosure relates to personal mobility vehicles with a rear powered wheel and/or other features.

Description of Certain Related Art

Many types of personal mobility vehicles exist, such as skateboards, scooters, bicycles, karts, etc. A user can ride such a vehicle to travel from place to place.

SUMMARY

However, a need still exists for new and/or improved designs, which may provide a new riding experience or unique functionality. The systems, methods and devices described herein have innovative aspects, no single one of which is indispensable or solely responsible for their desirable attributes. Without limiting the scope of the claims, certain features of some embodiments will now be summarized.

In some configurations, a powered board vehicle is disclosed. The powered board vehicle includes a flexible deck having a forward portion and a rearward portion; at least one front wheel connected with the deck under the forward portion, the front wheel configured to swivel about a first axis and rotate about a second axis; and a powered rear wheel connected with the deck and in a fixed alignment relative to the deck; wherein the deck permits rotation of the front portion relative to the rear portion to permit a user to twist the forward portion relative to the rearward portion in alternating directions about a longitudinal axis of the deck. In some configurations, the rear wheel comprises a hub motor. In some configurations, the front wheel and the rear wheel are aligned with a longitudinal axis of the vehicle. In some configurations, a diameter of the front wheel is different from a diameter of the rear wheel. In some configurations, a diameter of the front wheel is equal to a diameter of the rear wheel.

In some configurations, the vehicle further includes two front, swivelable wheels connected with the deck under the forward portion, the two front wheels aligned such that an axis passing through the center of each of the front wheels is orthogonal to a longitudinal axis of the vehicle when the two front wheels are aligned parallel to the longitudinal axis of the vehicle. In some configurations, the two front wheels are supported by a mounting bracket that is supported by the deck, wherein the mounting bracket is configured to move relative to the deck. In some configurations, the mounting bracket can pivot or rock relative to the deck.

In some configurations, the vehicle further includes a rotational coupling or other torsional-flex-facilitating structure between the forward portion and the rearward portion of the deck. In some configurations, the rotational coupling includes one or more pivot assemblies and/or a biasing element to bias the forward portion and the rearward portion into a neutral or aligned relative position.

In some configurations, the deck further comprises a molded plastic platform to provide a gripping surface on a top surface of the deck. In some configurations, the deck further comprises a thin portion in a lateral direction between the forward portion and the rearward portion to allow the deck to twist or flex. In some configurations, a lateral axis bisects the deck at a midpoint of the deck, the lateral axis orthogonal to the longitudinal axis of the deck, the forward portion of the deck narrows to a point forward of the lateral axis and the thin portion is rearward of the lateral axis. In some configurations, the deck is relatively consistent in lateral width throughout at least a midpoint of its length and a source of power is supported by the deck.

In some configurations, the vehicle further includes a wired or wireless remote control that controls the powered rear wheel.

In another configuration, a powered personal mobility vehicle includes a body having a deck, the deck being configured to support a user, the deck having a forward portion and a rearward portion; a caster assembly connected with the deck; at least one front wheel connected with the caster assembly and rotatable about a first axis; a rear wheel connected with the body and rotatable about a second axis; and a motor connected with the body and arranged to transfer rotational force to the rear wheel wherein the forward and the rearward portions are spaced apart by a neck portion that is laterally narrower than both the forward portion and the rearward portion, thereby allowing the deck to twist or flex about a longitudinal axis of the vehicle that passes through the neck.

In some configurations, the forward portion of the deck narrows to a pointed tip.

In some configurations, the vehicle includes two front caster wheels connected to a mounting bracket connected to the body such that an axis passing through a center of each of the front wheels is orthogonal to a longitudinal axis of the body when the front caster wheels are oriented parallel to the longitudinal axis of the body. In some configurations, the mounting bracket is configured to move relative to the deck. In some configurations, the front wheel and the rear wheel are aligned with a longitudinal axis of the vehicle.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

DETAILED DESCRIPTION OF CERTAIN EMBODIMENTS

Figure 1:
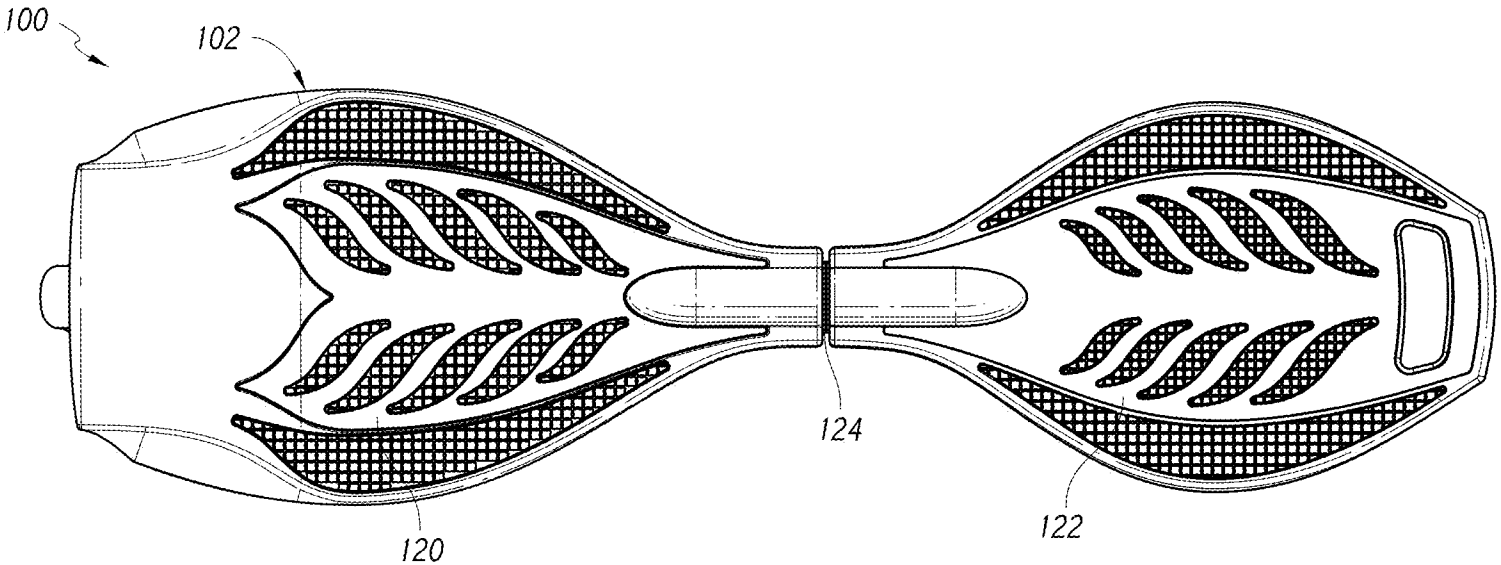
FIG. 1 is a top view of a skateboard according to an embodiment.
Figure 2:
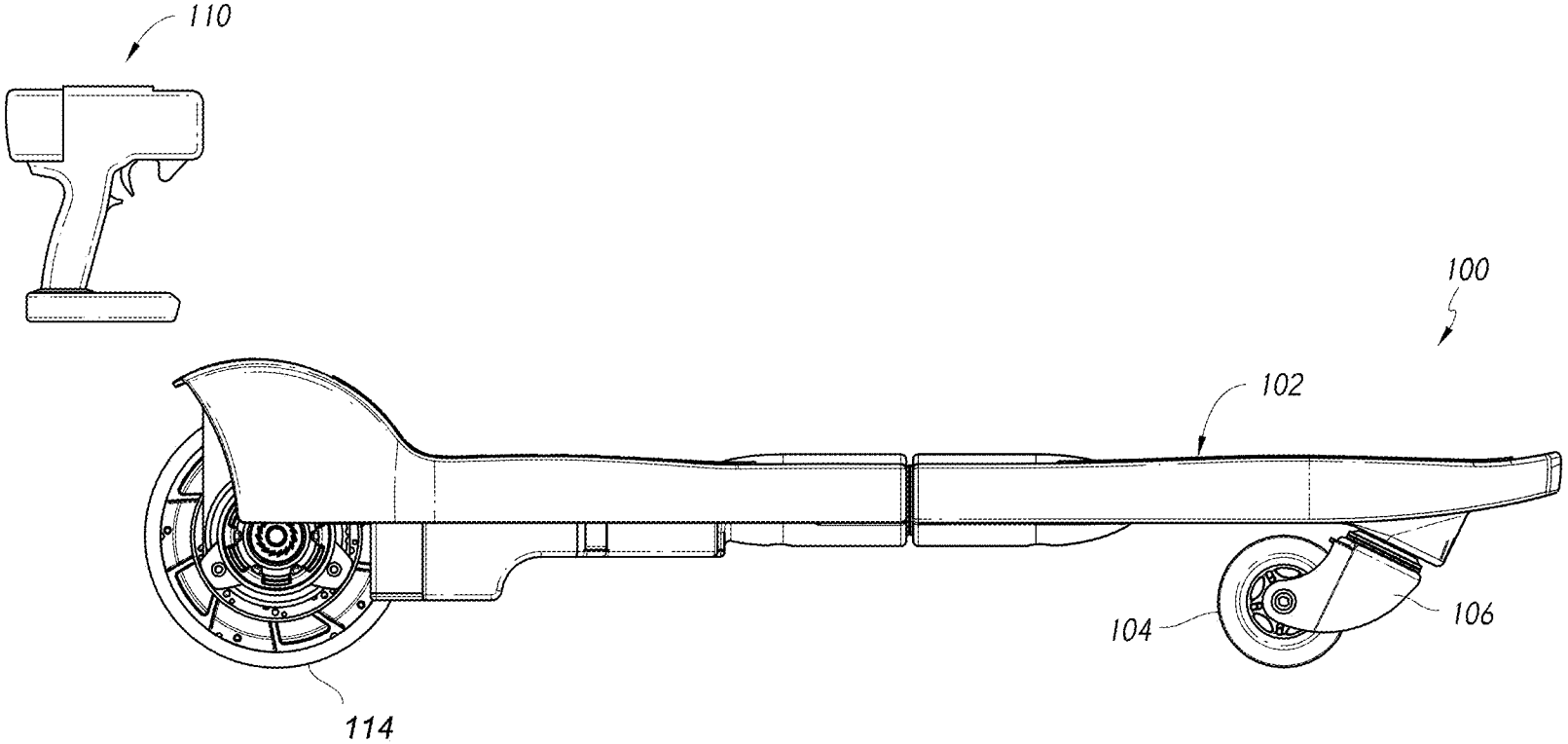
FIG. 2 is a side view of the skateboard of FIG. 1 and a control unit.
Figure 3:
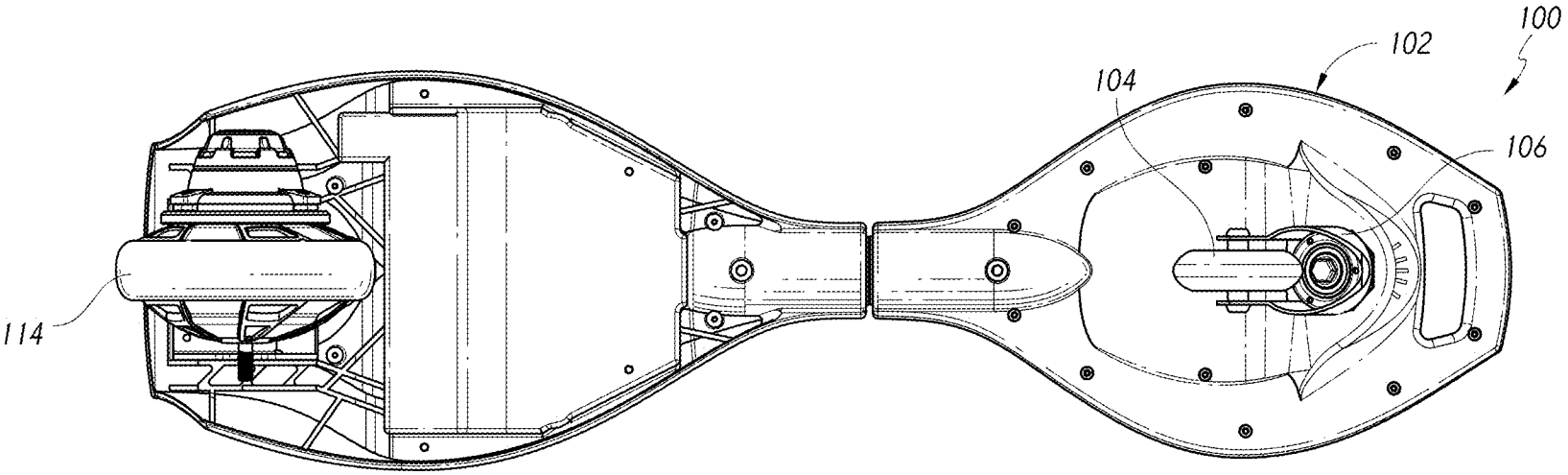
FIG. 3 is a bottom view of the skateboard of FIG. 1.
Figure 4:
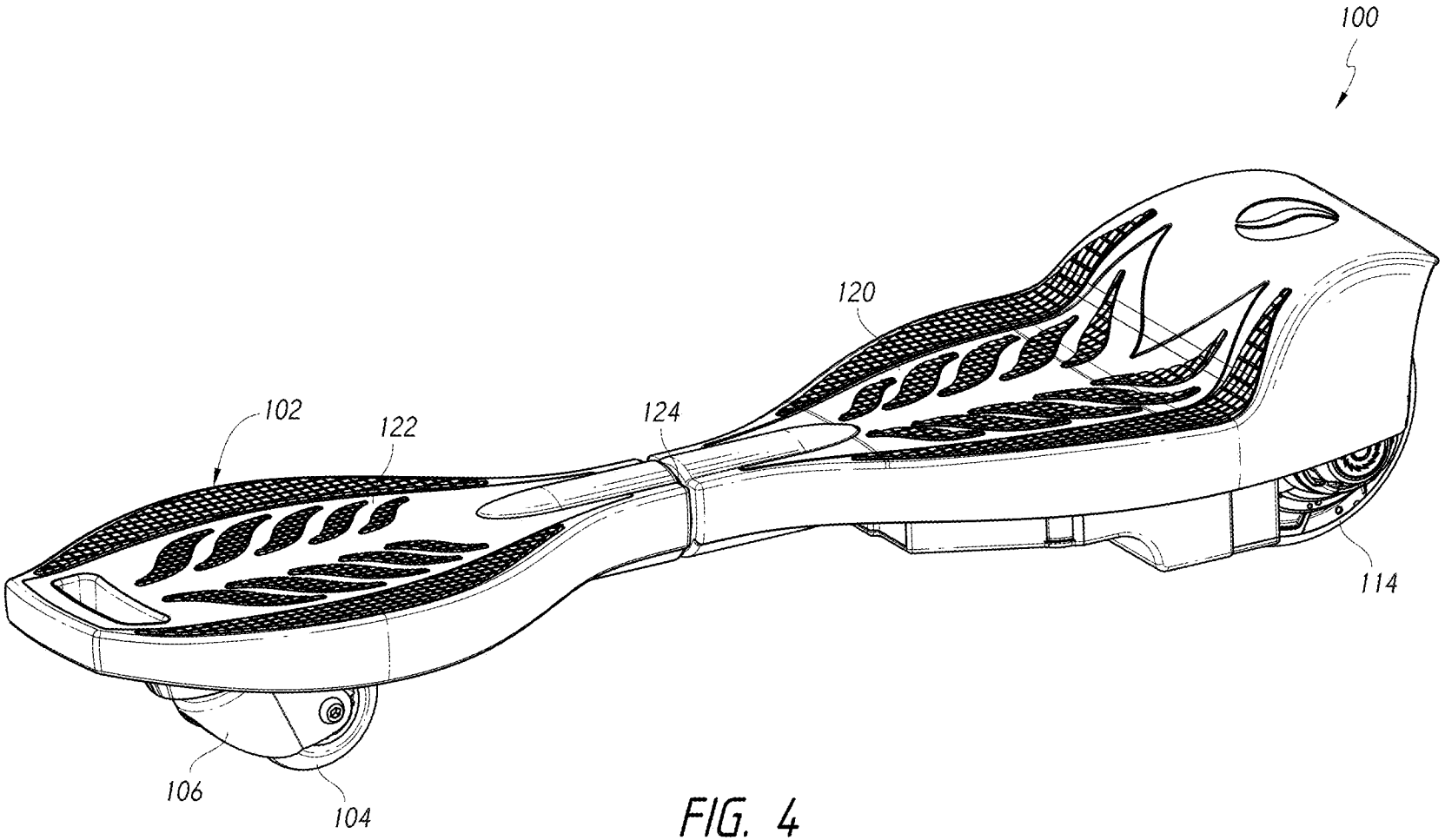
FIG. 4 is a top front perspective view of the skateboard of FIG. 1.
Figure 6:
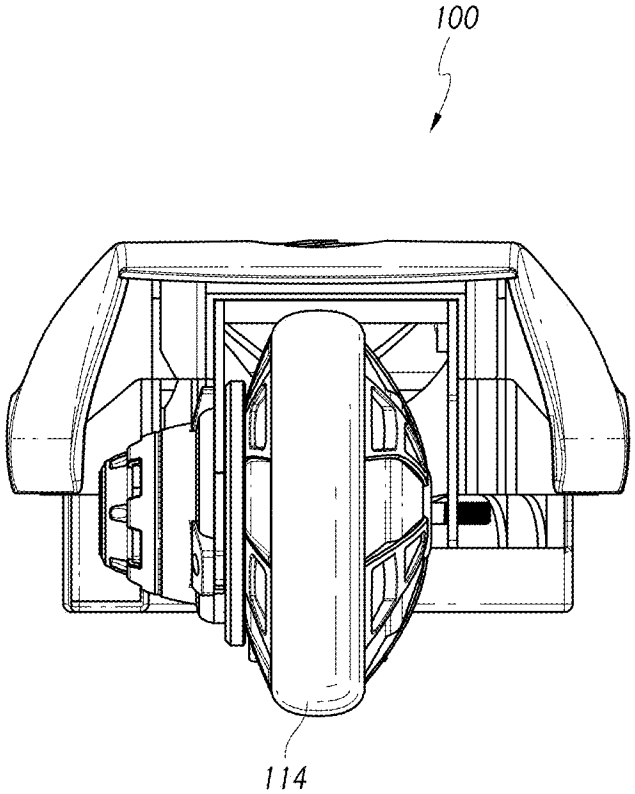
FIG. 6 is a rear view of the skateboard of FIG. 1.
Figure 5:
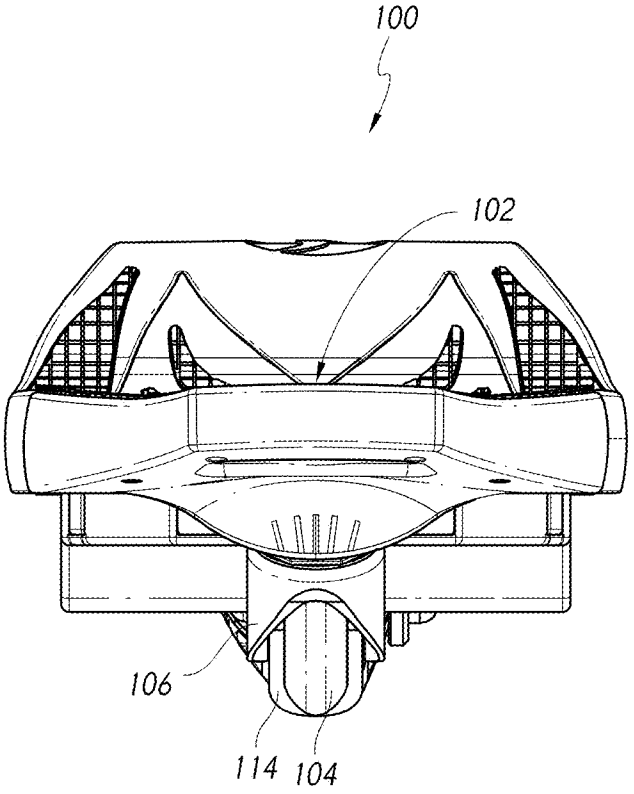
FIG. 5 is a front view of the skateboard of FIG. 1.

Embodiments of systems, components and methods of assembly and manufacture will now be described with reference to the accompanying figures, wherein like numerals refer to like or similar elements throughout. Although several embodiments, examples and illustrations are disclosed below, it will be understood by those of ordinary skill in the art that the inventions described herein extends beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Certain terminology may be used in the following description for the purpose of reference only, and thus are not intended to be limiting. For example, terms such as "above" and "below" refer to directions in the drawings to which reference is made. Terms such as "front," "back," "left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import. Throughout the following description, like numbers refer to like components.

Overview

Various embodiments of powered wheeled board vehicles are disclosed. As described in more detail below, the vehicles can include one or more powered rear wheels and one or more swivelable (e.g., caster) front wheels. Conventionally, this combination would be thought to render the vehicle inherently unstable, difficult to ride, and/or hard to control. This combination was typically thought to be particularly problematic when used on vehicles (e.g., skateboards) configured to permit twisting or flexing of the deck.

Furthermore, the addition of a powered rear wheel would typically be thought to negate the need for a swivelable front wheel. Some vehicles include swivelable front and rear wheels, as well as a deck that is configured to twist or flex, which can allow the user to create a locomotive force. But, with the addition of the powered rear wheel to provide the locomotive force, the swivelable front wheel would typically be thought to be unneeded. Accordingly, the swivelable front wheel would normally be replaced with a fixed (e.g., non-swivelable) wheel, such as to reduce cost, increase stability, etc.

Additionally, it was conventionally thought that positioning a powered wheel in the front of certain vehicles was preferred to placing the powered wheel in the rear of the vehicle. For example, having the powered wheel in the rear of the vehicle could be thought to reduce controllability compared to having the powered wheel in the front.

Nevertheless, certain embodiments described herein have shown that a vehicle can successfully include a powered rear wheel and one or more swivelable front wheels. In spite of the aforementioned and other concerns, such a vehicle can be sufficiently controllable and stable to provide an enjoyable riding experience.

Certain Vehicles With One Front Wheel

FIGS. 1-6 illustrate a powered wheeled board vehicle 100 having a deck 102 connected with a pair of wheels 104, 114. In the illustrated arrangement, the rear wheel 114 is powered, such as by an electric motor, and the front wheel 104 is swivelably connected with a caster assembly 106. The caster assembly 106 allows the front wheel to 104 to swivel about a first axis and rotate about a second axis (e.g., generally orthogonal to the first axis). Preferably, the rear wheel 114 is fixed in orientation relative to the deck 102. In the illustrated arrangement, the vehicle 100 includes inline wheels. That is, the front wheel 104 and the rear wheel 114 are aligned with a longitudinal axis of the vehicle 100 (when the front wheel 104 is in a straight or neutral position). In some configurations, such as those shown in FIGS. 1-6, the front wheel and the rear wheel can have different diameters, such as the rear wheel having a diameter that is at least twice the diameter of the front wheel. In other configurations, the front and rear wheels may be substantially the same or the same diameter.

In the illustrated embodiment, the rear wheel is powered by a hub motor arrangement (e.g., a motor integrated with the wheel 114). The hub motor arrangement or drive wheel arrangement includes a body or housing, which at least partially encloses a motor and transmission assembly. Preferably, a tire or other traction element that contacts a surface upon which the associated vehicle is ridden is adjacent to or is directly carried by the housing. That is, preferably, a diameter of the traction element is similar to but preferably slightly larger than a diameter of the housing and no substantial structural elements (e.g., spokes and rim) are provided between the housing and the traction element. Thus, the hub motor arrangement is well-suited for small diameter wheel applications, such as ride-on vehicles for children, such as the skateboards illustrated in the embodiments discussed herein, Preferably, the motor is a standard, commercially-available small DC brush motor. The transmission assembly is configured to convert the speed and torque of the motor into a speed and torque suitable for the drive wheel (housing and traction element or wheel). In addition, the motor and transmission assembly are configured for accommodation in the housing that is suitably sized and shaped for use as a drive wheel for a small vehicle. In part, this is accomplished by positioning the motor preferably along a center axis of the hub motor arrangement and offset axially or laterally to one side of a central plane of the hub motor arrangement or of the traction element. However, in some configurations, the motor could be off-center and/or spaced from the center axis of the hub motor arrangement. Preferably, the motor is surrounded by one or both of a support bearing for the housing and a mount 114*a* of the hub motor arrangement. In some arrangements, a portion of the motor is laterally or axially inboard of the support bearing and/or mount 114*a* that is nearest the motor (if multiple bearings/mounts are provided) and a portion of the motor is laterally or axially outboard of the support bearing and/or mount 114*a*. Advantageously, with such an arrangement, a standard motor can be used along with a transmission assembly suitable to convert the power of the motor into suitable drive power for the drive wheel arrangement to provide a relatively low-cost drive system for small or child vehicle applications. In addition, such an arrangement preserves space for the transmission of the hub motor arrangement.

In some embodiments, the hub motor arrangement is not a through-shaft type of arrangement in which an axle member or arrangement passes completely through the center of the hub motor, but is a distributed axle arrangement that provides suitable support while permitting the motor to be centrally-located or aligned with a central, rotational axis of the hub motor arrangement and to occupy a portion of the axis of rotation. That is, the motor is not a hollow design that surrounds the axis of rotation. Such an arrangement provides a well-balanced hub motor arrangement while permitting the use of a standard, commercially-available "off-the-shelf" motor to keep costs low. Although through-shaft type axle designs can also permit a motor to be aligned with a central, rotational axis of a motor, such an arrangement would require a custom motor design or at least a large motor design because the axle needs to be sufficient to support a substantial portion of the weight of the associated vehicle. In the illustrated arrangement, the shaft of the motor preferably does not support any significant weight of the associated vehicle. Additional details and features related to hub motors can be found in U.S. Patent Application Publication No. 2015/0133253, filed on Jun. 27, 2014, and U.S. Patent Application Publication No. 2015/0239527, filed on May 12, 2015, each of which are hereby incorporated by reference in their entirety.

In some embodiments, the motor is separate from the rear wheel 114. In such arrangements, the motor and the rear wheel 114 can be coupled by a suitable drive arrangement, such as a chain drive, belt drive or gear drive, among other possibilities. A source of power, such as a battery, can be provided at a suitable location, such as below the deck 102 or integrated with the deck 102.

The motor can be controlled by a wired or wireless remote control 110. The remote control 110 can include a transmitter and a trigger or other suitable control(s). Movement of the trigger and/or the amount of movement of the trigger can be detected, such as by a sensor in the remote control 110. This information can be used (e.g., by a processor or in the remote control 110 or on the skateboard 100) to determine an amount of motive power to be provided by the motor. In some embodiments, the transmitter can transmit a signal corresponding to the amount of trigger movement and a receiver on the skateboard 100 can receive the signal, which can be used to control the motor. As illustrated, in some embodiments, the trigger comprises an accelerator to control motive power provided by the motor. Although a "pistol-grip" style of remote control 110 is shown, other configurations are contemplated as well, such as a button, switch, joystick, toggle, slider, trackball, smartphone app, or otherwise. In some configurations, the remote control 110 is the only element of the vehicle 100 that is controlled with a hand. For example, in some implementations, although the throttle is controlled via remote control 110, the user controls all other aspects of the vehicle 100 with his or her feet in a manner similar to a normal or caster skateboard. In at least some configurations, the vehicle 100 does not include a handlebar or other hand support that is connected to the deck 102 or other portion of the vehicle 100.

In contrast to certain powered vehicles with controls on handlebars or other supports, the remote control 110 can allow a user to move both of his or her hands during operation of the vehicle, while still being able to control locomotion of the vehicle. In some embodiments, the remote control 110 is configured to be held and operated by a single hand. In some embodiments, remote control 110 can facilitate user safety, such as by not restraining the user's hands to handlebars or other supports, and instead readily allowing the user to move his or her hands to catch the user in the case of a fall.

In some configurations, the vehicle 100 can include a brake, which can be controlled by the remote control 110. In some embodiments, the braking functionality is provided by the motor. In some variants, the brake comprises a drum brake, disk brake, caliper brake, or otherwise.

Figure 17:
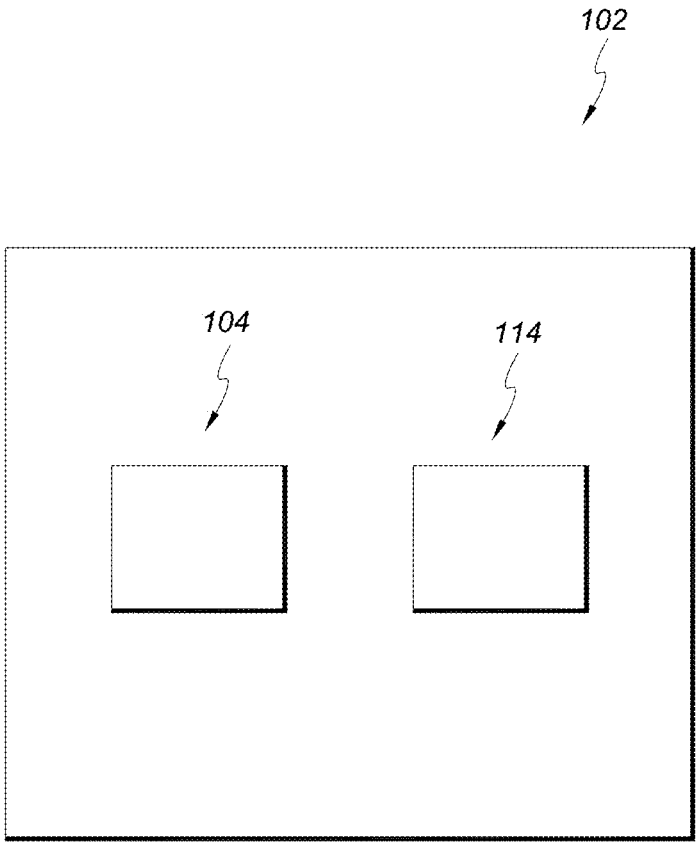
FIG. 17 schematically illustrates an embodiment with a rear caster wheel.

The deck 102 can be of any suitable size, shape or arrangement. As illustrated in FIGS. 1-6, the deck 102 includes a first or forward portion 122 that connects with the front wheel 104 and a second or rearward portion 120 that connects with the rear wheel 114. In some embodiments, such as in the embodiment shown, the forward portion 122 and the rearward portion 120 are coupled, such as by a rotational coupling 124. This can permit rotational movement of the forward portion 122 relative to the rearward portion 120, such as along the longitudinal axis of the vehicle 100. The rotational coupling 124 can include one or more pivot assemblies and/or a biasing element to bias the forward portion 122 and the rearward portion 120 into a neutral or aligned relative position. For example, the deck 102 can be configured as shown, substantially as shown or similarly to the arrangements disclosed in U.S. Pat. Nos. 7,195,259 and 7,775,534, the entireties of which are hereby incorporated by reference herein. In some embodiments, the forward and rearward portions 120, 122 are coupled by a flexible neck. The deck 102 can include a front board mounted over a caster wheel 104 and a rear board mounted over a caster wheel 114. FIG. 17 schematically illustrates the rear caster wheel.

Figure 7:
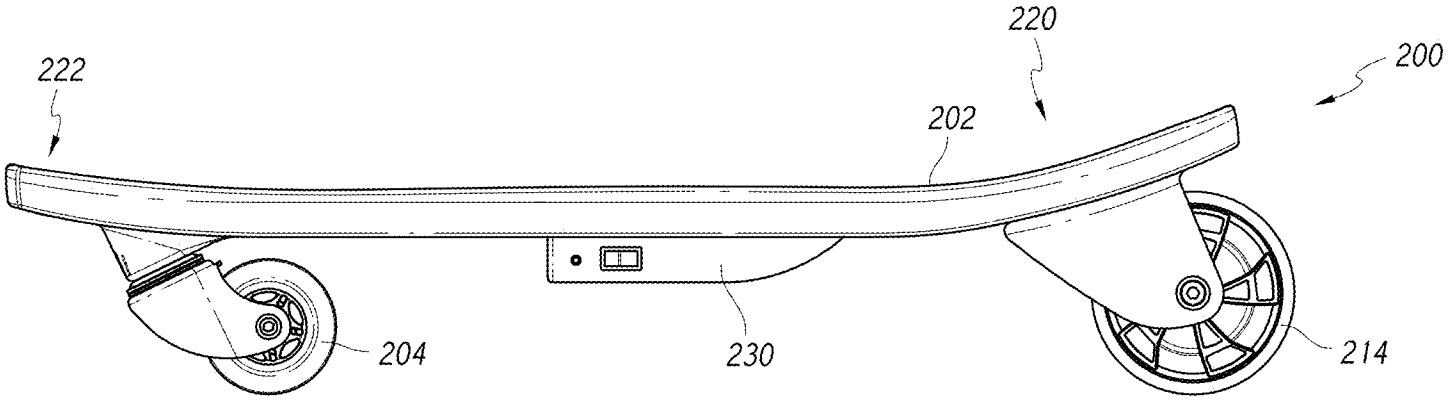
FIG. 7 is a side view of a skateboard according to another embodiment.
Figure 8:
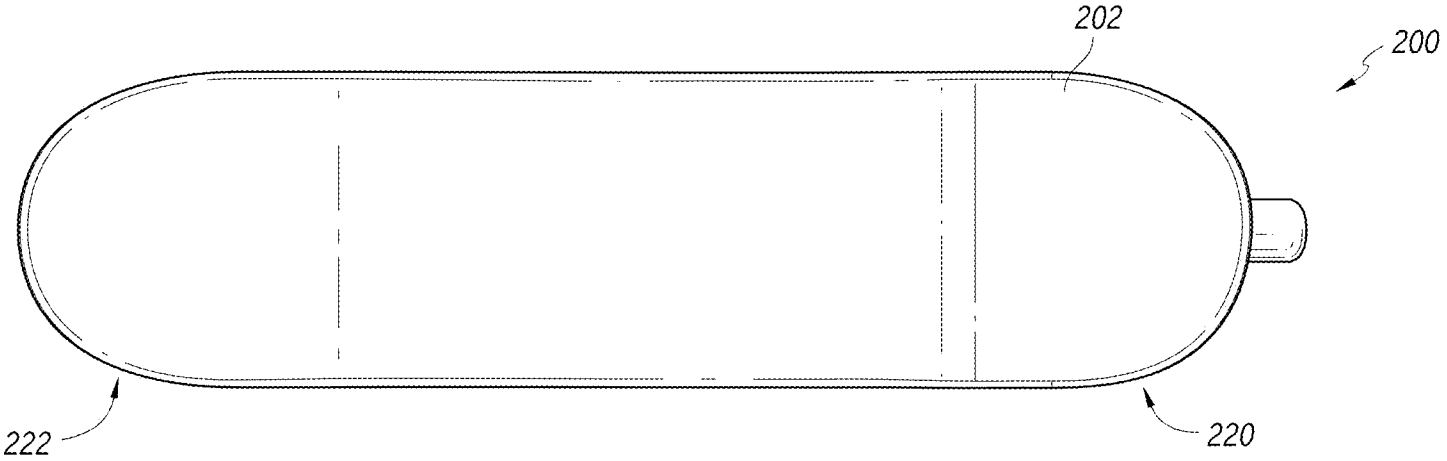
FIG. 8 is a top view of the skateboard of FIG. 7.

In some configurations, as illustrated in FIGS. 7 and 8, the vehicle 200 can include a deck 202 that is relatively consistent in lateral width throughout its length or at least within a mid-portion of its length (generally between a forward portion 222 and a rearward portion 220 of the deck 202). In some implementations, at least a majority of the length of the lateral sides of the deck 202 is substantially parallel with the longitudinal axis of the vehicle 200. A source of power, such as a battery 230, can be provided at a suitable location, such as below the deck 202 or integrated with the deck 202. If a hub motor is provided, it can be the same as, substantially the same as or similar to the hub motors discussed above and disclosed in U.S. Patent Application Publication No. 2015/0133253, filed Jun. 27, 2014, and/or U.S. Patent Application Publication No. 2015/0239527, filed May 12, 2015, which are each hereby incorporated by reference in their entirety. As shown, in certain embodiments, the rearward portion 220 comprises an angled tail, such as an angled tail at least about 10° from the longitudinal axis of the deck 202. In certain implementations, the rear wheel 214 and/or the motor connect with the angled tail of the rearward portion 220.

Figure 9:
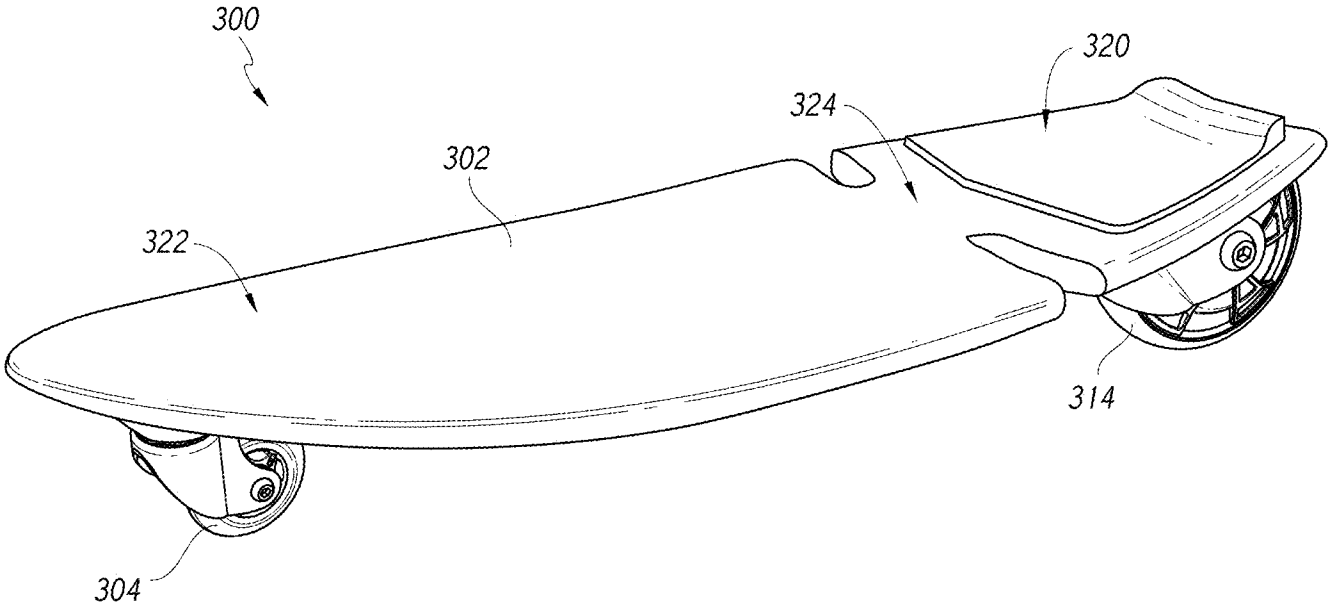
FIG. 9 is a top front perspective view of a skateboard according to another embodiment.
Figure 10:
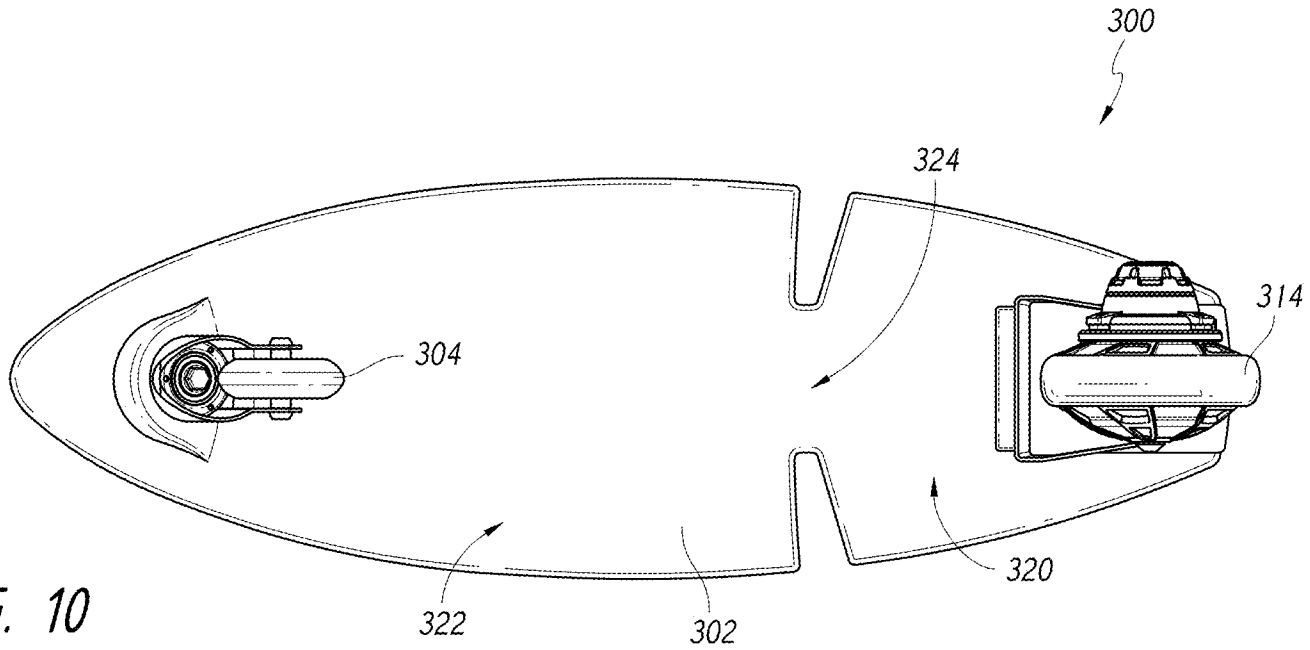
FIG. 10 is a bottom view of the skateboard of FIG. 9.

Another configuration of a powered wheeled vehicle 300 is shown in FIGS. 9 and 10. In this configuration, the powered wheeled board vehicle 300 has a deck 302 with a triangular or arrowhead-like shape that resembles the shape of a surfboard or boogie board. The deck 302 has a forward portion 322 and a rearward portion 320. The forward portion 322 narrows to a point such that the sides of the deck 322 converge to a point at a forward end of the deck 302. As shown, in certain embodiments, the rearward portion 320 comprises an angled tail, such as an upwardly angled tail at least about 10° from the longitudinal axis of the deck 302. In certain implementations, the rear wheel 314 and/or the motor connect with the angled tail of the rearward portion 320.

As further illustrated in FIGS. 9 and 10, in some embodiments, the forward portion 322 and the rearward portion 320 are rigidly coupled, such as through a neck that is laterally narrower than the portions 320, 322. For example, the deck 302 can have a neck portion 324 between the forward portion 322 and the rearward portion 320. In various embodiments, the neck portion 324 is thinner in the lateral direction than the forward portion 322 and the rearward portion 320. For example, ratio of the maximum lateral width of the forward portion 322 to the maximum lateral width of the neck portion 324 can be at least: 1.5:1, 2:1, 3:1, 4:1, or other ratios. Some examples of configurations comprising neck portions are shown in FIGS. 9, 10, 15, and 16, as well as in U.S. Pat. Nos. 7,338,056, 7,600,768 and 7,766,351 (which are hereby incorporated by reference herein in their entirety). In some configurations, a lateral axis bisects the deck at a midpoint of the deck and the lateral axis is orthogonal to a longitudinal axis of the deck. In some configurations, the forward portion 322 narrows to a point forward of the lateral axis and a thin or neck portion 324 is rearward of the lateral axis.

The neck portion 324 can be configured to allow the deck 302 to flex or twist. In various embodiments, the deck 302 can flex or twist in response to pressure from the user's feet, such as due to the user's weight shifting laterally on the deck 302. This can result in forward portion twisting or rotating relative to the rearward portion in alternating directions about a longitudinal axis of the deck. The flex or twist of the deck 302 can be used to steer, control, and/or propel the vehicle 300. Further description of this feature can be found in U.S. Pat. Nos. 7,338,056, 7,600,768 and 7,766,351.

Certain Vehicles With Multiple Front Wheels

In some configurations, as illustrated in FIGS. 11, 12, and 14-16, the vehicle 400 can include a deck 402 that connects with multiple front wheels 404, such as two, three, or more. Preferably, the front wheels are caster wheels. Preferably, the deck 402 also connects with a rear powered wheel 414. In some embodiments, the deck can connect with more than one rear powered wheel, such as two, three, or more. As illustrated, there can be two or more front caster wheels 404 arranged side-by-side such that an axis passing through the center of each of the front wheels is orthogonal to a longitudinal axis of the vehicle 400 when the two front wheels 400 are in a neutral orientation or aligned parallel to the longitudinal axis of the vehicle 400 or in other arrangements.

Figure 11:
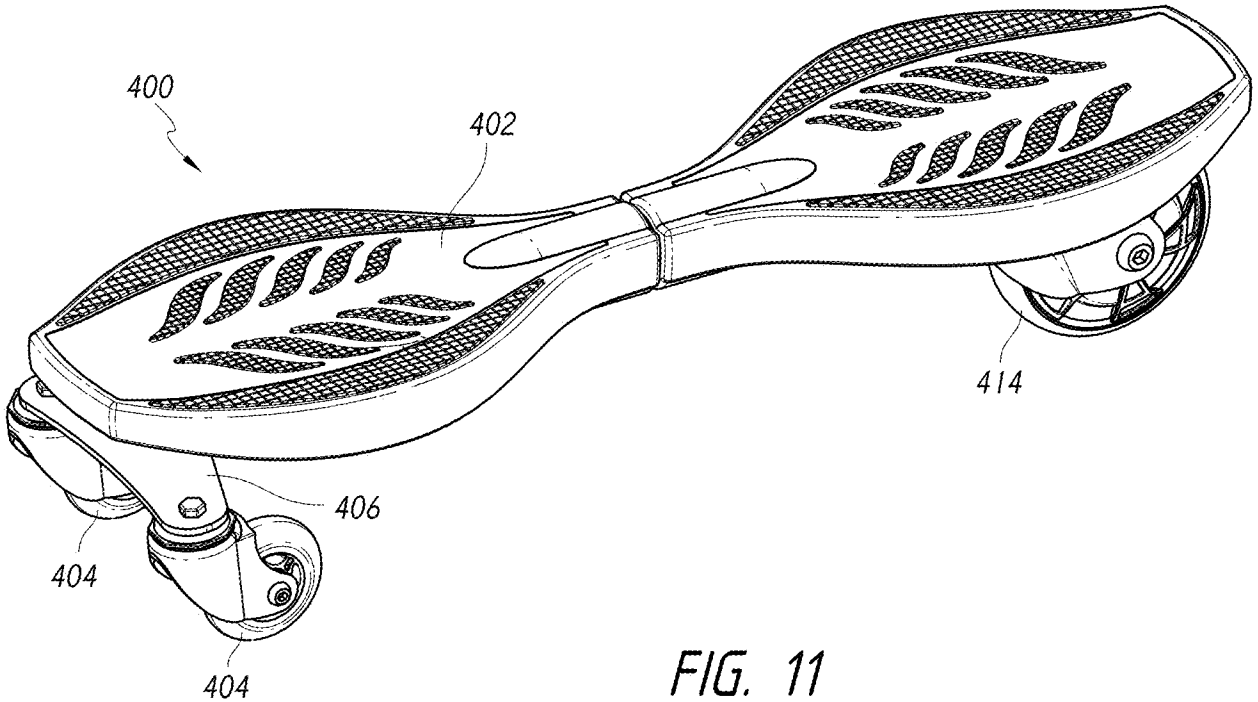
FIG. 11 is a top front perspective view of a skateboard according to another embodiment.
Figure 13:
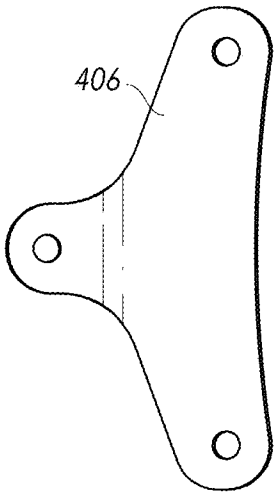
FIG. 13 is a top view of a caster wheel attachment member.
Figure 12:
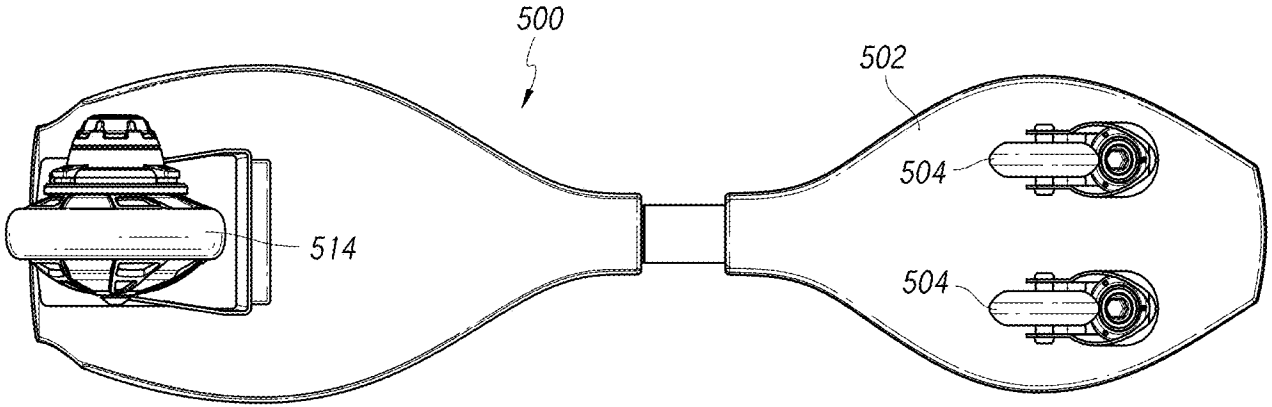
FIG. 12 is a bottom view of a skateboard according to another embodiment.
Figure 15:
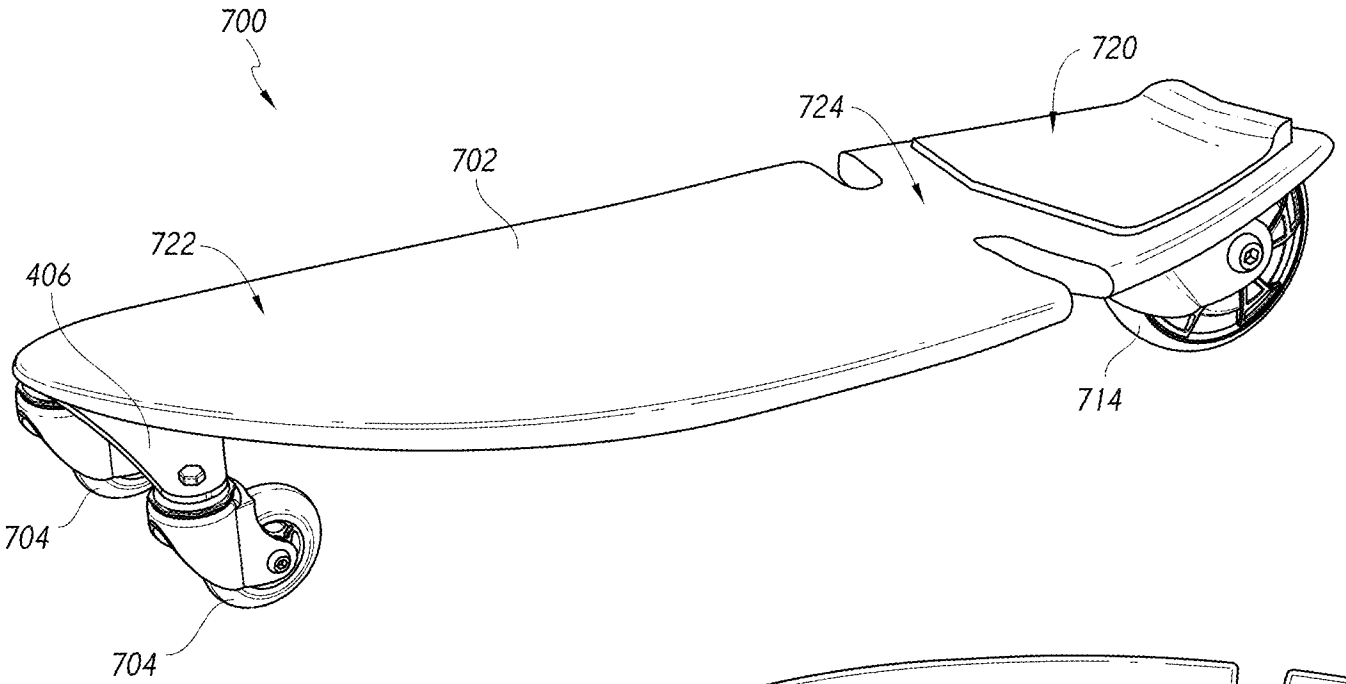
FIG. 15 is a top front perspective view of a skateboard according to another embodiment.
Figure 16:
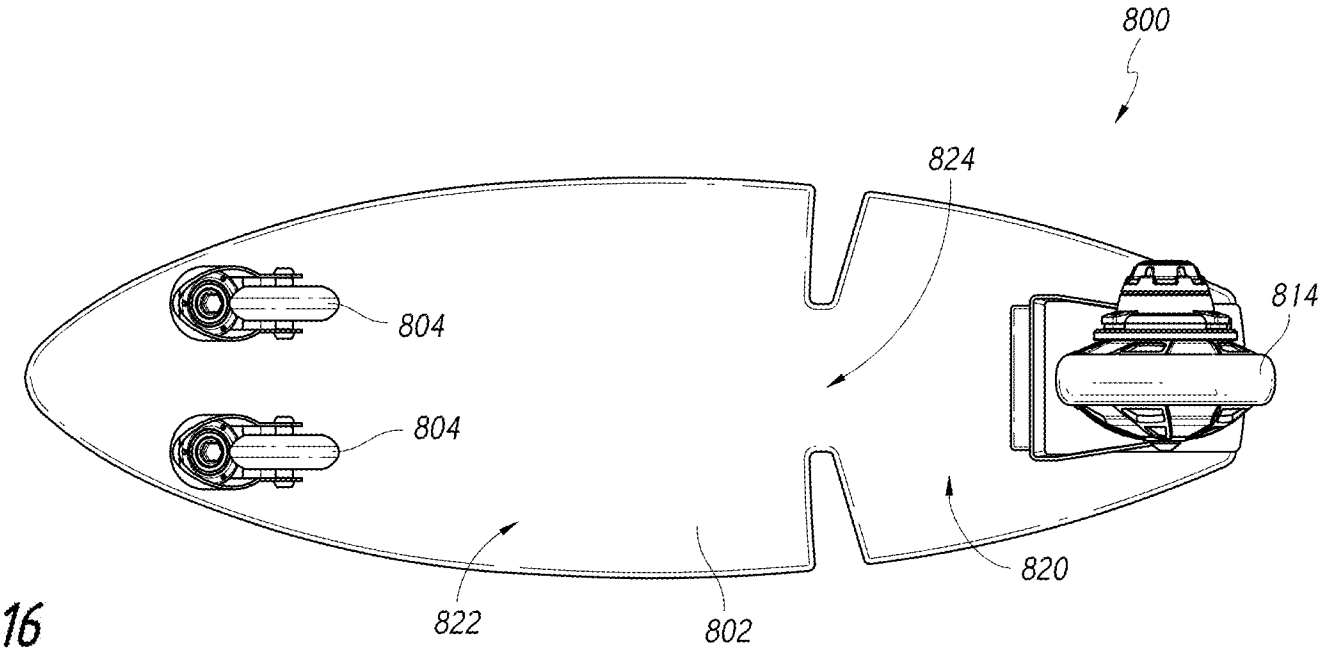
FIG. 16 is a bottom view of a skateboard according to another embodiment.

In some embodiments, as shown in FIG. 11, the front caster wheels 404 are connected with a mounting bracket 406, which in turn is connected with the deck 402 of the vehicle 400. The mounting bracket 406 can be configured to move relative to the deck 402. For example, in some embodiments, the mounting bracket 406 can pivot and/or rock relative to the deck 402. Examples of embodiments of mounting brackets 406 are shown in FIGS. 11, 13, and 15. In some configurations, the deck can directly connect with multiple front wheels (that is, without a mounting bracket). Examples of such direct connection configurations are shown in FIGS. 12, 14, and 16.

Figure 14:
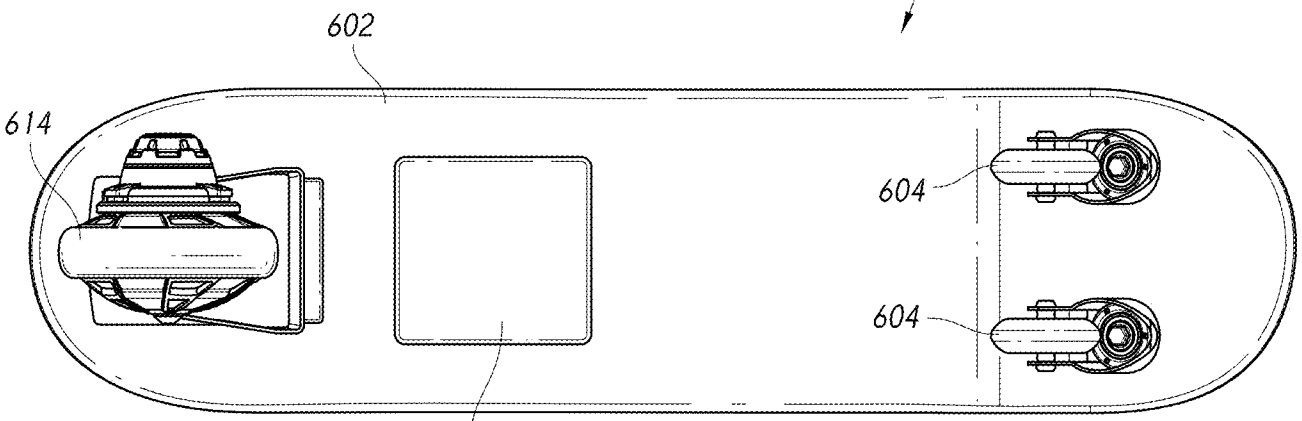
FIG. 14 is a bottom view of a skateboard according to another embodiment.

In some configurations, as illustrated in FIGS. 7 and 14, the deck 402 can also support a battery pack 430, as discussed above. The battery pack 430 may be mounted on an underside of the deck 402 between the front wheels and the rear wheel. In some configurations, the battery pack 430 may be mounted on an underside of the front portion or on an underside of the rear portion.

In addition to the embodiments shown in FIGS. 11, 12, and 14-16, the other embodiments disclosed in this application can also be configured to include two or more front wheels which can change the riding characteristics of the vehicle.

Operation of the Vehicle

In operation, the user places his or her feet generally on the front portion and rear portion of the deck 102. The user may rotate his or her body, shift his or her weight, and/or modify his is or her foot positions to control the motion of the vehicle 100. For example, for steering, one side of the deck 102 can be tilted towards the ground to encourage a turn in that direction. In some configurations, the vehicle 100 may be operated as a flexible skateboard in that the user may cause, maintain, or increase locomotion of the vehicle 100 by causing the front and rear portions to be twisted or rotated relative to each other generally about a longitudinal axis of the deck 102.

In various embodiments, the rear wheel 114 can be used to accelerate or decelerate the vehicle. For example, the remote control 110 can be used to send a signal to control (e.g., increase or decrease) an amount of power provided to the rear wheel by the motor and/or to initiate a braking action. The user can still control steering of the vehicle 100 by rotating his or her body, or by shifting his or her weight and/or foot position, on the deck 102 as discussed above.

In contrast to a conventional skateboard, movement of the vehicle 100 can be provided without the user needing to move his or her feet. For example, from a stopped position, the user can place his or her feet on the deck 102 and can actuate the trigger on the remote, thereby causing the motor to drive the rear wheel, which in turn propels the vehicle. In some embodiments, the user does not need to lift a foot off the deck and push off the ground in order to provide locomotion. In certain variants, the user does not need to move his or her feet (e.g., to cause the forward and rearward portions to move relative to one another) in order to provide locomotion.

Conclusion

Many variations and modifications may be made to the herein-described embodiments, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described.

A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

The terms "approximately," "about," and "substantially" as used herein represent an amount close to the stated amount that still performs a desired function or achieves a desired result. For example, in some embodiments, as the context may dictate, the terms "approximately", "about", and "substantially" may refer to an amount that is within less than or equal to 10% of the stated amount. The term "generally" as used herein represents a value, amount, or characteristic that predominantly includes, or tends toward, a particular value, amount, or characteristic. For example, as the context may dictate, the term "generally parallel" can mean something that departs from exactly parallel by less than or equal to 15°.

Some embodiments have been described in connection with the accompanying drawings. The figures are drawn to scale, but such scale should not be interpreted to be limiting. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Also, any methods described herein may be practiced using any device suitable for performing the recited steps.

In summary, various illustrative embodiments and examples of powered wheeled boards have been disclosed. Although the powered wheeled boards have been disclosed in the context of those embodiments and examples, this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims that follow as well as their full scope of equivalents.

What is claimed is:

1. A powered wheeled board comprising:

a deck configured to support a user, the deck comprising:

a forward portion;

a rearward portion; and a neck portion that is laterally narrower than the forward and rearward portions and that spaces the forward and the rearward portions apart from each other;

a first caster wheel connected with the deck;

a second caster wheel connected with the deck;

a hub motor arranged to provide propulsion to the powered wheeled board, the hub motor protruding laterally out of a side of the second caster wheel;

a power source configured to provide electric power to the hub motor; and a control unit comprising a processor and a receiver, the control unit configured to control the amount of electric power provided by the power source to the hub motor.

2. The powered wheeled board of claim 1, further comprising a remote control that is configured to wirelessly communicate with the control unit to control the amount of power provided to the hub motor.

3. The powered wheeled board of claim 1, wherein the front wheel and rear caster wheels are located on a longitudinal axis of the powered wheeled board.

4. The powered wheeled board of claim 1, wherein a diameter of the first caster wheel is different from a diameter of the second caster wheel.

5. The powered wheeled board of claim 1, wherein a diameter of the first caster wheel is equal to a diameter of the second caster wheel.

6. The powered wheeled board of claim 1, further comprising a third caster wheel connected with the deck.

7. The powered wheeled board of claim 1, wherein the neck comprises a biasing element that biases the forward and rearward portions into a neutral position.

8. The powered wheeled board of claim 1, wherein the first and second caster wheels have different lateral widths.

9. The powered wheeled board of claim 1, further comprising a handle, the handle comprising an aperture that extends through the deck.

10. The powered wheeled board of claim 1, further comprising a support bearing that surrounds the hub motor.

11. The powered wheeled board of claim 1, further comprising a support bearing, wherein a portion of the hub motor is laterally inboard of the support bearing and a portion of the hub motor is laterally outboard of the support bearing.

12. The powered wheeled board of claim 1, wherein the second caster wheel is positioned under the rearward portion.

* * * * *